US005431386A

United States Patent [19]

Blaser

[11] Patent Number: 5,431,386

[45] Date of Patent: Jul. 11, 1995

[54] SHEET-GUIDING ASSEMBLY IN A DELIVERY SYSTEM OF A PRINTING PRESS

[75] Inventor: Peter T. Blaser, Dielheim, Germany

[73] Assignee: Heidelberger Druckmaschinen AG, Heidelberg, Germany

[21] Appl. No.: 72,523

[22] Filed: Jun. 4, 1993

[30] Foreign Application Priority Data

Jun. 4, 1992 [DE] Germany ..... 42 18 421.5

[51] Int. Cl.[6] ..... B65H 29/04

[52] U.S. Cl. ..... 271/204; 271/277; 198/606

[58] Field of Search ..... 271/204, 277, 271, 233; 198/604, 606, 626.1

[56] References Cited

U.S. PATENT DOCUMENTS 3,413,732 12/1968 Uoch et al. .
3,809,214 5/1974 Reist ..... 271/204 X
4,333,559 6/1982 Reist ..... 271/204 X
4,409,741 10/1983 Bonomi .

FOREIGN PATENT DOCUMENTS 627851 3/1936 Germany .
643980 9/1937 Germany .
1260482 2/1968 Germany .
2407752 9/1974 Germany .
446462 4/1936 United Kingdom .
1429446 3/1976 United Kingdom .

*Primary Examiner*—H. Grant Skaggs
*Assistant Examiner*—Carol L. Druzbick
*Attorney, Agent, or Firm*—Herbert L. Lerner; Laurence A. Greenberg

[57] ABSTRACT

A sheet-guiding assembly in a sheet delivery system of a sheet-fed printing press includes a plurality of sheet grippers disposed on at least one endlessly revolving chain of a first gripper system for gripping a leading edge of a sheet, and a plurality of after-grippers disposed on at least one endlessly revolving chain of a second gripper system for gripping a trailing edge of the sheet, the sheet delivery system being extended in length and defining a horizontal transport path for the sheet therethrough, the first and second gripper systems being disposed so as to be adjustable in phase with respect to one another at the extended sheet delivery system, the sheet grippers and the after-grippers being attached to the first and the second gripper systems, respectively, for holding the sheet by the leading and trailing edges thereof, respectively, on the horizontal transport path of the sheet over the length of the sheet delivery system.

5 Claims, 3 Drawing Sheets

SHEET-GUIDING ASSEMBLY IN A DELIVERY SYSTEM OF A PRINTING PRESS

SPECIFICATION

The invention relates to a sheet-guiding assembly in a sheet delivery system of a printing press and, more particularly, to such a sheet delivery system wherein sheet grippers disposed on endlessly revolving chains of a first gripper system grip a leading edge of a sheet, and after-grippers disposed on endlessly revolving chains of a second gripper system grip a trailing edge of the sheet.

In sheet-fed printing presses, particularly sheet-fed rotary offset printing presses, having an extended sheet delivery system in accordance with the practical state of the art, a sheet is guided horizontally on a relatively long transport path before the sheet arrives at a location above a sheet pile and is deposited. On the transport path, the sheet is held at its leading edge by grippers of a transport system, the grippers being carried by gripper bars disposed transversely to the sheet-transport direction. The gripper bars are attached to two chains which revolve laterally in synchronism with one another and are connected to the printing-press drive. Because the sheet, such as a paper sheet, particularly, is held only at its leading edge, the trailing edge thereof flutters very violently, thereby striking or impacting with sheet-guiding plates, cross-members, and the like, and becoming damaged. This problem arises especially when hot-air drying systems have been installed, because a strong air current intensifies the fluttering movement of the sheet as it is transported through the dryer system. Independently of this problem, German Patents 627 851 and 643 980 disclose a sheet-guiding arrangement in a sheet delivery of a printing press wherein after-grippers grip the sheet at its trailing edge before the sheet is deposited on the pile of sheets, the after-grippers holding the sheet and slowing it down to a standstill. The foregoing heretofore known arrangements thus act as sheet brakes and are supposed to improve the deposition of the sheet on the sheet pile in a manner similar to how this is achieved with the arrangement according to German Published Non-prosecuted Patent Application (DE-OS) 24 07 752 by aftergrippers on a rotating transfer cylinder.

Heretofore known from German Patent 12 60 482 is a drying device for printed sheets connected to the last printing unit of a sheet-fed printing press. In this drying device, a sheet, which is gripped at its leading and trailing edges by respective rows of grippers, is guided by endless chain conveyors vertically upwards through a heating device and, after reversing direction, vertically downwards through a cooling device. In this heretofore known drying device, in addition to the rows of grippers which grip the leading edge of the sheet, further rows of grippers grip the trailing edge of the sheet, the further rows of grippers, for the purpose of matching or conforming to the sheet size or format, being adjustable with respect to the rows of grippers gripping the leading edge of the sheet. It has further become known from this German patent that the revolving chain conveyor with the rows of grippers for the trailing edge of the sheet is disposed within the chain conveyor with the rows of grippers for the leading edge of the sheet. The transport of the sheet through the drying device requires a one-sided support of the sheet on adjustable rods, so that it is not possible to use the device in first form and perfector or recto and verso printing.

Starting from sheet-guiding arrangements or assemblies having an extended sheet delivery in printing presses, particularly sheet-fed rotary offset printing presses, it is an object of the invention, in contrast therewith, to provide a sheet-guiding assembly in an extended sheet delivery wherein a sheet is reliably guided and simultaneously held taut or stiff on a rectilinear transport path through the sheet delivery.

With the foregoing and other objects in view, there is provided, in accordance with the invention, a sheet-guiding assembly having features which are conventional for braking a sheet, and the improvement, in a sheet delivery system of a sheet-fed printing press, comprising a plurality of sheet grippers disposed on at least one endlessly revolving chain of a first gripper system for gripping a leading edge of a sheet, and a plurality of after-grippers disposed on at least one endlessly revolving chain of a second gripper system for gripping a trailing edge of the sheet, the sheet delivery system being extended in length and defining a horizontal transport path for the sheet therethrough, the first and second gripper systems being disposed so as to be adjustable in phase with respect to one another at the extended sheet delivery system, the sheet grippers and the after-grippers being attached to the first and the second gripper systems, respectively, for holding the sheet by the leading and trailing edges thereof, respectively, on the horizontal transport path of the sheet over the length of the sheet delivery system.

Accordingly, provided in order to tauten and hold the sheet is the second gripper system formed of laterally revolving chains, gripper bars interconnecting the latter, and grippers attached to the gripper bars, the second system being driven by the printing-press drive in synchronism with the first gripper system, but being phase-adjustable with respect to the first gripper system. The synchronized drive of both systems may be effected by direct incorporation thereof in a gear train for driving the printing press and the sheet delivery, or by means of a separate electric drive controlled through the intermediary of a position sensor of the printing press. In the case of the latter alternative, a sheet-size or format adjustment would be effected, for example, by a phase-lagging or phase-leading, i.e., a slowing down or speeding up, of the separate drive. Analogous with the first gripper system, the second gripper system advantageously also has two laterally revolving chains and gripper bars interconnecting the chains transversely to the transport direction of the sheet. Preferably, mechanically acting grippers are employed for the leading edge of the sheet as well as similarly acting after-grippers for gripping the trailing edge of the sheet; it is possible, however, also to provide suction bars or other gripper systems in place of such mechanically acting grippers.

Due to the features of the invention, it is possible with relatively little effort to implement or produce rectilinear sheet guidance along any desirable or required length ahead or upstream of the sheet-delivery pile in order, for example, to create sufficient space for accommodating a hot-air dryer.

For this purpose, in accordance with another feature of the invention, the sheet-guiding assembly includes a device for drying printed sheets disposed in the extended sheet delivery system, and means for guiding the sheet grippers and the after-grippers of the first and the second gripper systems, respectively, along a respective horizontal path through the device.

In accordance with a further feature of the invention, each of the first and second gripper systems is formed of two laterally revolving delivery chains and of respective pluralities of gripper bars disposed transversely to the sheet transport direction of the sheet and connecting the delivery chains of each of the gripper systems to one another.

In accordance with an added feature of the invention, means are provided for guiding a lower side of the delivery chains of one of the gripper systems and an upper side of the delivery chains of the other of the gripper systems in parallel with one another. This is adequate for accommodating or installing a suitable hot-air dryer.

In accordance with an additional feature of the invention, the endlessly revolving delivery chains of the first gripper system define an inner space, and the endlessly revolving gripper chains of the second gripper system are disposed within the inner space.

In accordance with yet another feature of the invention, each of the first and second gripper systems has front and rear direction-reversing means for reversing the revolving direction of the respective delivery chains thereof, the rear direction-reversing means of the first gripper system comprising sprocket wheels for the respective delivery chains thereof mounted on a supporting shaft, the rear direction-reversing means of the second gripper system comprising sprocket wheels for the respective delivery chains of the second gripper system mounted on a hollow shaft surrounding and coaxially supported on the supporting shaft.

In accordance with yet a further feature of the invention, the front direction-reversing means of the second gripper system is offset with respect to the front direction-reversing means of the first gripper system, in sheet transport direction along the sheet transport path, and is disposed in the vicinity of a rear edge of the sheet pile, as viewed in the sheet transport direction.

In accordance with a concomitant feature of the invention, the sheet-guiding assembly includes a frame for the assembly, a driving gear train having a driving gearwheel mounted on the support shaft outside the frame, a pinion shaft journalled in the frame and carrying a pair of pinions, one of the pinions being located on the inside and the other of the pinions on the outside of the frame, and a gearwheel mounted on the hollow shaft, the one pinion being in meshing engagement with the hollow-shaft gearwheel, and the other pinion being in meshing engagement with the driving gearwheel for driving the hollow shaft.

Phase-shifting of the drive of both chain gripper systems for effecting a paper-size or format adjustment may be performed in a conventional manner by adjusting the phase of both driving gearwheels for the second gripper system provided with the aftergrippers for gripping the trailing edge of the sheet.

Other features which are considered as characteristic for the invention are set forth in the appended claims.

Although the invention is illustrated and described herein as embodied in a sheet-guiding assembly in a delivery system of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
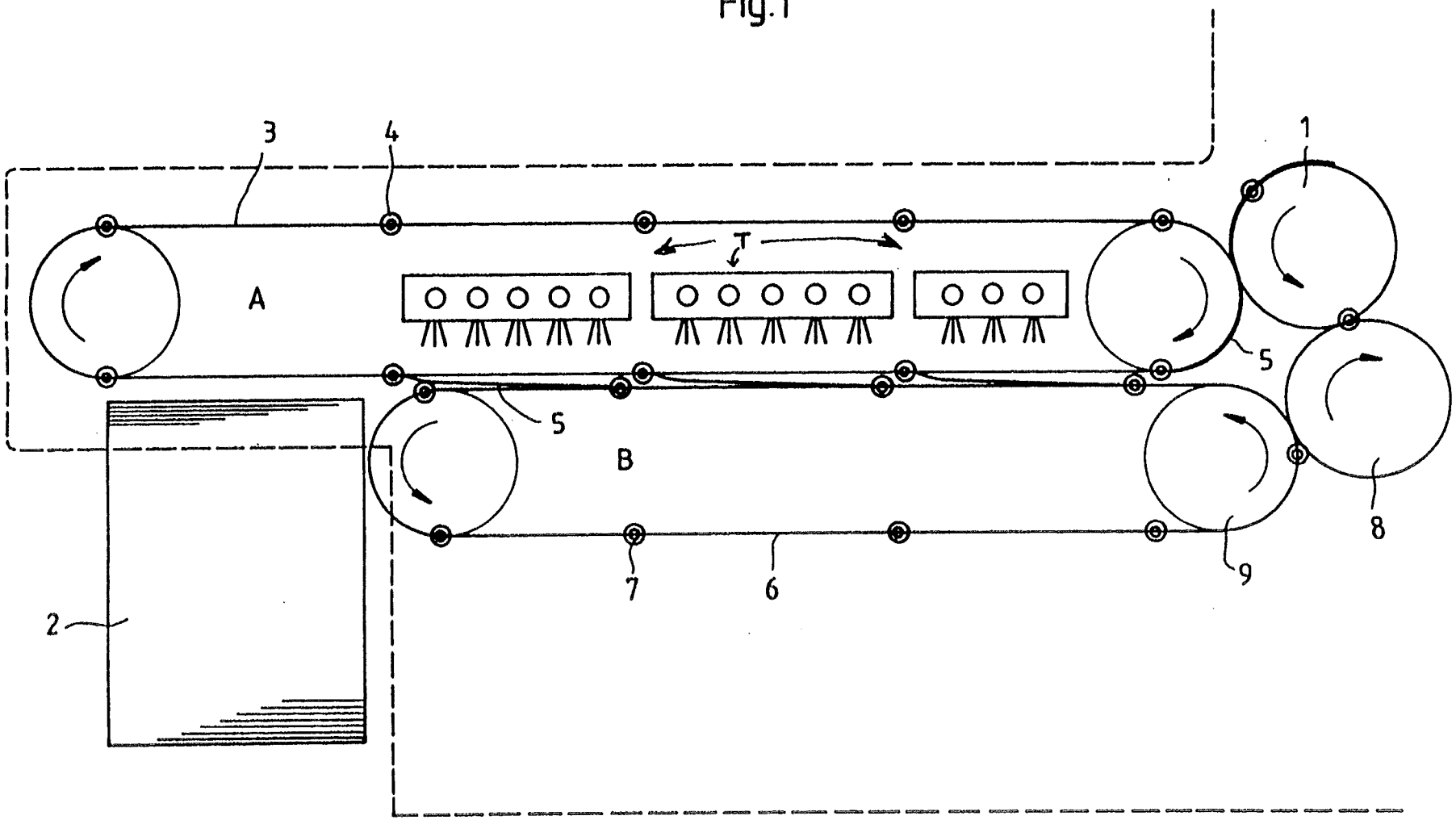
FIG. 1 is a diagrammatic side elevational view of a first embodiment of the sheet-guiding assembly according to the invention.

Referring now more particularly to the figures of the drawings, the embodiments of the sheet-guiding assembly according to the invention which are illustrated therein relate to an extended sheet delivery system of a sheet-fed rotary offset printing press wherein, for example, hot-air dryers, ultraviolet (UV) dryers or the like identified generally by the reference character T are disposed between a last printing unit of a printing press and a sheet pile 2. In the sheet delivery system, a sheet 5 is guided more-or-less horizontally on a relatively long path between a transfer cylinder 1 and the sheet pile 2 before it is deposited on the sheet pile 2. For guiding the sheet 5, a first sheet-delivery system A is provided, which is formed of one delivery chain 3 or two delivery chains revolving parallel to one another, to which transversely extending gripper bars 4 are fastened having mechanically acting sheet grippers disposed thereon and distributed across the width of the sheet-delivery system A. The sheet grippers of the gripper bars 4 grip the leading edge of the sheet 5 at a tangent point thereof with the transfer cylinder 1, and guide the sheet 5 on the more-or-less horizontally extending lower side of the chain, as viewed in FIGS. 1 and 2, to the sheet pile 2.

In the embodiment of the sheet-guiding assemby shown in FIG. 1, below the gripper system A, a second gripper system B is disposed having either one delivery chain 6 or two delivery chains revolving parallel to one another, to which there are attached gripper bars 7 having mechanically acting grippers likewise disposed thereon and distributed across the width of the chains. The latter grippers are in the form of after-grippers which grip the trailing edge of the sheet 5 at the beginning of the rectilinear transport path of the sheet through the delivery system and which effect a slight tensioning or tautening of the sheet. The upper side of the delivery chain 6 runs parallel to the lower side of the delivery chain 3.

The drive of the gripper system A is effected, for example, by incorporating a gearwheel into the gear train of the printing press, either through the intermediary of the impression cylinder or the transfer cylinder 1. The drive of the second gripper system B is effected, for example, by an intermediate gearwheel 8 likewise through the intermediary of the transfer cylinder 1, the teeth of the intermediate gearwheel 8 engaging with toothing formed on a sprocket wheel 9 of the second gripper system. For sheet-size or format adjustment, the phase relationship between the intermediate gearwheel 8 and the gearwheel on the sprocket 9 is shifted or displaced, so that the spacing between the grippers for the leading edge of the sheet 5 on the gripper bar 4 and the grippers on the gripper bar 7 for the trailing edge of the sheet is reduced. In the region of the sheet pile 2, the sheets 5 are released both by the grippers for the leading edge of the sheet and also by the after-grippers for the trailing edge of the sheet, so that the sheet drops, possibly with the aid of conventional auxiliary means, onto the sheet pile.

Figure 2:
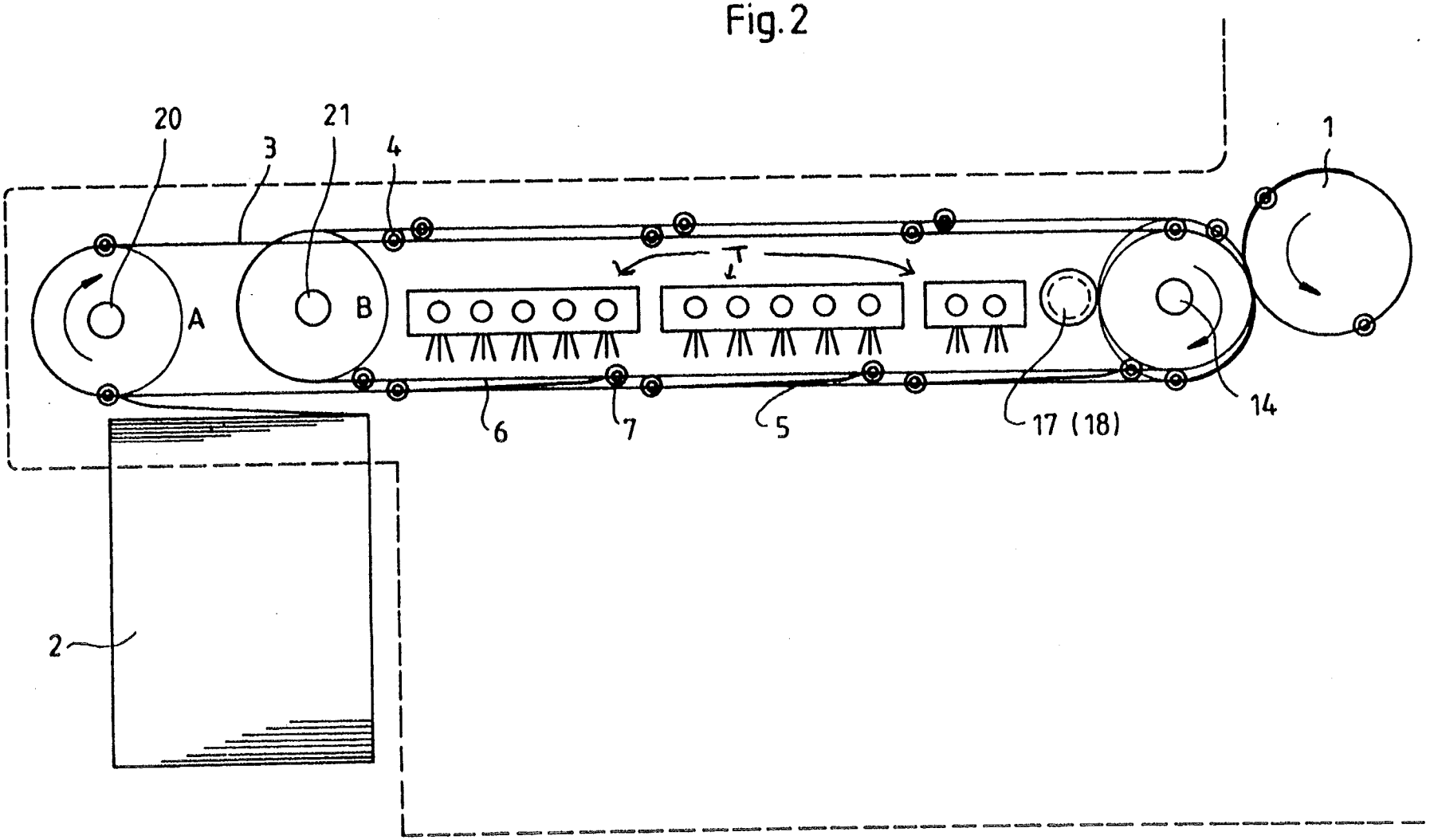
FIG. 2 is a diagrammatic view like that of FIG. 1 of a second embodiment of the sheet-guiding assembly.
Figure 3:
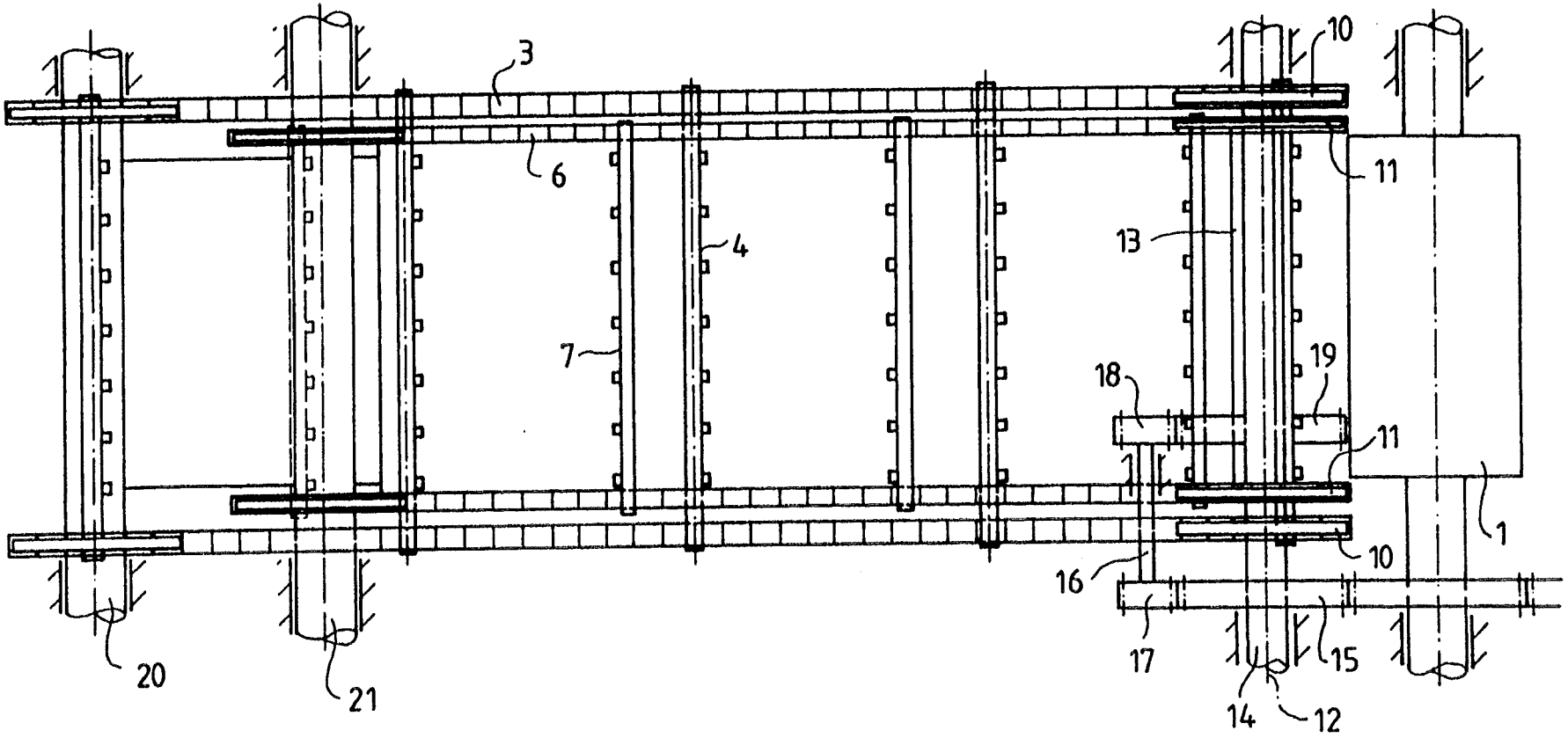
FIG. 3 is a diagrammatic top plan view of FIG. 2.

In the embodiment shown in FIGS. 2 and 3, which is preferred because of the smaller overall space required therefor, the gripper system B formed of the delivery chains 6 and, attached thereto, the gripper bars 7 with grippers for the trailing edge of the sheet 5, is disposed within the gripper system A. Rear sprocket wheels 10 and 11 of both gripper systems A and B are disposed on a common axis 12, on the one hand, on a hollow shaft 13 and, on the other hand, on a shaft 14, rotatably supported coaxially therein.

Also in the assembly of FIGS. 2 and 3, the drive of the gripper system A is effected by incorporating a gearwheel 15 on the shaft 14 into the gear train, e.g. through the intermediary of the transfer cylinder 1. For the drive of the gripper system B, a pinion 17 mounted on a shaft 16, outside a frame, meshes with the gearwheel 15 so that a pinion 18 mounted on the same shaft 16, within the frame, drives a gearwheel 19 mounted on the hollow shaft 13. By turning the pinion 17 with respect to the gearwheel 15, it is possible to alter the phase relationship or position of the sprocket wheels of both chain systems and thereby effect sheet-size or format adjustment.

Sprocket-wheel shafts 20 and 21 of the front or forward direction-reversing arrangements of the chains of both gripper systems A and B may likewise, in the aforedescribed manner, be disposed on a common axis or offset in the longitudinal direction of the sheet transport, as shown in FIGS. 2 and 3. Horizontal components of the gripping force applied by the grippers holding the trailing edge of the sheet, those horizontal components decreasing in the region of the direction-reversing arrangement, can thus be utilized for braking the sheet. In such an arrangement, the function of the suction roller at the delivery pile 2 could be taken over by the second gripper system.

The foregoing is a description corresponding in substance to German Application P 42 18 421.5, dated Jun. 4, 1992, the International priority of which is being claimed for the instant application, and which is hereby made part of this application. Any material discrepancies between the foregoing specification and the aforementioned corresponding German application are to be resolved in favor of the latter.

I claim:

1. Sheet-guiding assembly in a sheet delivery system of a sheet-fed printing press, comprising a plurality of sheet grippers disposed on at least one endlessly revolving chain of a first gripper system for gripping a leading edge of a sheet, and a plurality of after-grippers disposed on at least one endlessly revolving chain of a second gripper system for gripping a trailing edge of the sheet, the sheet delivery system being extended in length and defining a horizontal transport path for the sheet therethrough, said first and second gripper systems being disposed so as to be adjustable in phase with respect to one another at the extended sheet delivery system, said sheet grippers and said after-grippers being attached to said first and said second gripper systems, respectively, for holding the sheet by the leading and trailing edges thereof, respectively, on the horizontal transport path of the sheet over the length of the sheet delivery system, each of the first and second gripper systems being formed of two laterally revolving delivery chains and of respective pluralities of gripper bars disposed transversely to the sheet transport direction of the sheet and connecting the delivery chains of each of the gripper systems to one another, and means for guiding a lower side of the delivery chains of one of the gripper systems and an upper side of the delivery chains of the other of the gripper systems in parallel with one another; wherein the endlessly revolving delivery chains of the first gripper system define an inner space, and the endlessly revolving gripper chains of the second gripper system are disposed within the inner space.

2. Sheet-guiding assembly according to claim 1, wherein each of the first and second gripper systems has front and rear direction-reversing means for reversing the revolving direction of the respective delivery chains thereof, the rear direction-reversing means of the first gripper system comprising sprocket wheels for the respective delivery chains thereof mounted on a supporting shaft, the rear direction-reversing means of the second gripper system comprising sprocket wheels for the respective delivery chains of the second gripper system mounted on a hollow shaft surrounding and coaxially supported on the supporting shaft.

3. Sheet-guiding assembly according to claim 2, wherein the front direction-reversing means of the second gripper system is offset with respect to the front direction-reversing means of the first gripper system, in sheet transport direction along the sheet transport path, and is disposed in the vicinity of a rear edge of a sheet pile, as viewed in the sheet transport direction.

4. Sheet-guiding assembly according to claim 2, including a frame for the assembly, a driving gear train having a driving gearwheel mounted on the support shaft outside the frame, a pinion shaft journalled in the frame and carrying a pair of pinions, one of the pinions being located on the inside and the other of the pinions on the outside of the frame, and a gearwheel mounted on the hollow shaft, the one pinion being in meshing engagement with the hollow-shaft gearwheel, and the other pinion being in meshing engagement with the driving gearwheel for driving the hollow shaft.

5. Sheet guiding assembly in a sheet delivery of a sheet-fed printing press, comprising:

a first gripper system having endlessly revolving gripper chains and a plurality of sheet grippers disposed on said endlessly revolving chains for gripping a leading edge of a sheet in the delivery of the sheet-fed printing press;

a second gripper system having endlessly revolving gripper chains and a plurality of sheet grippers disposed on said endlessly revolving chains for gripping a trailing edge of a sheet in the delivery of the sheet-fed printing press;

said first and second gripper systems being disposed at a extended delivery and having means for adjusting a phase position of said first and second gripper systems relative to one another, and means for causing said grippers to hold the sheet travelling along a horizontal transport path across the length of the delivery at the leading edge and at the trailing edge thereof, and said endlessly revolving chains of said first gripper system defining an inner space and said endlessly revolving gripper chains of said second gripper system being disposed within said inner space.

* * * * *